US005767430A

United States Patent [19]

Yamanoue et al.

[11] Patent Number: 5,767,430

[45] Date of Patent: Jun. 16, 1998

[54] SOUND SOURCE CONTROLLING DEVICE

[75] Inventors: Kaoru Yamanoue, Tokyo; Ayako Okita; Takeshi Hashimoto, both of Kanagawa, all of Japan

[73] Assignee: Sony Corporation, Tokyo, Japan

[21] Appl. No.: 565,988

[22] Filed: Dec. 1, 1995

[30] Foreign Application Priority Data

Dec. 2, 1994 [JP] Japan ..... 6-300025

[51] Int. Cl.[6] ..... G10H 1/00; G10H 1/18

[52] U.S. Cl. ..... 84/602; 84/604; 84/615

[58] Field of Search ..... 84/602, 604–607, 84/609–612, 615–618, 626, 633, 636, 649–650, 652

[56] References Cited

U.S. PATENT DOCUMENTS

| | | | |
|---|---|---|---|
| 5,146,833 | 9/1992 | Lui | 84/462 |
| 5,266,736 | 11/1993 | Saito | 84/612 |
| 5,515,474 | 5/1996 | Deacon et al. | 395/2.1 |
| 5,541,360 | 7/1996 | Kaneko | 84/660 |

FOREIGN PATENT DOCUMENTS

| | | |
|---|---|---|
| 0 463 411 A2 | 1/1992 | European Pat. Off. . |
| 0 597 381 A2 | 5/1994 | European Pat. Off. . |
| WO 94/11858 | 5/1994 | WIPO . |

*Primary Examiner*—William M. Shoop, Jr.
*Assistant Examiner*—Marlon T. Fletcher
*Attorney, Agent, or Firm*—Hill & Simpson

[57] ABSTRACT

The present invention provides a sound source controlling device in which the processing load required for interpretation of music data may be varied, depending upon the CPU load. The interval of music data interpretation is changed, without changing the music data itself, and the reproduced music composition is not changed in tempo. A system load judgment unit 152 compares the system load information acquired by a system load information acquisition unit 151, with a threshold value stored in a system load threshold value holding unit 153, and accordingly selects a timer interrupt interval held by a timer interrupt interval holder 131. A time information supervisor 143 supervises the acquisition of music paper data held by a music paper data holder, responsive to the timer interrupt interval held by an internal resolution holder 145. A sound enunciation/sound erasure information controller 144 controls a sound source based upon the acquired music paper data.

8 Claims, 6 Drawing Sheets

SOUND SOURCE CONTROLLING DEVICE

BACKGROUND OF THE INVENTION

This invention relates to a sound source controlling device in which a music score (paper data) having recorded thereon music information such as the music interval, sound enunciation, rests (sound erasure) or tone color effects of the produced sound in time sequence, is captured at a pre-set interval, and a sound source device is controlled based upon the captured music paper data for automatic performance of e.g., a music composition. More particularly, it relates to a sound source controlling device responsive to the results of calculation or the operation by the user in a video game device or an information processing device for generating the sound effects or background music (BGM).

Heretofore, it has been practiced in a video game device or personal computer to generate the music sound or sound effects responsive to the progress of the game or operation by the user.

In a video game device or a personal computer, a so-called FM music source for changing the frequency of a waveform synthesized from e.g., the fundamental wave and its harmonics for generating a sound with a sound interval, or a PCM music source for holding the waveform of the fundamental wave on memory and changing the read-out period of the fundamental wave responsive to the specified sound interval for generating a sound interval, has been used as a sound source device for generating the sound.

With such video game device or personal computer, the sound effects generated, the start and stop and the sound volume of the performance of the background music (BGM) can be instantly changed on a real-time basis, responsive to actuation by the user.

For reproducing the BGM, music paper data, having the interval of the generated sound, sound enunciation and erasure (signifying a rest or pause), and tone color effects arrayed thereon time-sequentially along with the time information, is previously prepared and interpreted on a real time basis for sequentially setting the sound interval, sound enunciation and sound erasure register of the sound source device.

The method of preparing e.g., BGM data in the form of a music paper data is suited to a multi-media computer game in which the property of promptly responding to the operation by the user plays an important role since the tone color, sound volume or the sound interval can be easily changed during reproduction as compared to a method of sequentially controlling the sound interval, sound enunciation or the sound erasure by program execution.

For controlling a sound source device based upon the music paper data by a video game device having only a central control unit (CPU) 201 as shown in FIG. 6, the CPU 201 is exploited time-divisionally for reading out music paper data at a pre-set time interval for controlling the sound emission timing, duration of sound emission, interval of the generated sound and the sound volume of a sound source device 202 for generating the BGM.

With the method of time-divisionally exploiting the CPU 201 for interpreting music paper data, the sound source control device is less costly and the program can be formulated more easily since there is no necessity of providing special peripheral devices provided that the CPU 201 has a sufficiently high processing capability.

With a game device having a subsidiary CPU 212 for controlling a sound source device 213 in addition to a main CPU 211, as shown in FIG. 7, the subsidiary CPU 212 is used, similarly to the CPU 201, for controlling the sound source device 213 based upon the music paper data.

With the method of employing the subsidiary CPU 212, the processing for generating the BGM may be carried out completely independently of the operation performed by the main CPU 211 for relieving the load of the CPU 211.

SUMMARY OF THE INVENTION

However, with the method of utilizing the subsidiary CPU 212, the cost of the device is increased since the dedicated subsidiary CPU 212 needs to be annexed for interpreting the music paper data. In addition, since a program for the subsidiary CPU 212 different from that of the main CPU 211 needs to be prepared, the program becomes complex and program formulation becomes difficult.

With the above-method of time-divisionally utilizing the CPU 201 for interpreting the music paper data, the load of calculation involved in processing other than music paper data interpretation such as picture drawing is increased with the consequence that the processing time of the CPU 201 allocated to the controlling of the sound source device 202 is relatively diminished.

In this case, if the time interval of executing the sound source control program is changed, the sound generation from the sound source device 202 is delayed, such that the tempo of the generated BGM is changed. For example, if the time interval of execution of the sound source control program is elongated, with the music paper data remaining unchanged, the tempo of the reproduced BGM becomes slower.

With this in view, a method is usually employed which consists in generating an interrupt at a pre-set time interval of e.g., 1/60 second and control is transferred to the sound source control program by such interrupt. Since this assures that the sound source control program is executed at all times at a pre-set time interval of e.g. 1/60 second, it is possible for the sound control program to effect time control of the music paper data on the basis of such assurance.

However, with the processing of actual games, it is a frequent occurrence that loads other than the sound source control program such as picture drawing, are increased instantaneously, so that it becomes desirable to prolong the time interval of starting the sound source program for diminishing the processing load of the sound source program.

In such case, it is necessary to vary the time interval of interrupt generation for starting the sound source control program responsive to the load imposed on the CPU in order to have plural sorts of music paper data for the same BGM in association with the time interval of starting of the sound source control program, thus increasing the volume of music paper data.

In view of the foregoing, it is an object of the present invention to provide a music sound source device in which the time interval of interpreting music paper data may be changed without changing music paper data and without changing the tempo of the reproduced music composition and in which the processing load of interpretation of the music paper data may be changed responsive to the load imposed on the CPU.

The sound source control device according to the present invention is configured for driving a sound source and for executing information processing other than the sound source recorded thereon the control information designed for controlling the sound source along with the time information. The sound source control device includes a sound source control information holder for holding the sound source control information, an interval holder for holding an interval of generating a plurality of timing signal, an interval setter for setting one of the intervals held by the interval holder as an interval of generating a timing signal, a timing signal generator for generating a timing signal at an interval as set by the interval setter, and a sound source controller for reading out the sound source control information corresponding to the interval as set by the interval setter from the sound source control information holder based upon the timing signal from the timing signal generator for controlling the sound source.

The sound source control device according to the present invention includes a load sensor for detecting the information processing load other than the sound source control, and a controller for controlling the interval by the interval setter responsive to a detection output of said load detection unit.

The sound source control device according to the present invention has a picture drawing processing as the information processing other than the sound source control.

With the sound source control device according to the present invention, the time setter sets one of the intervals held by the interval holder as an interval generating a timing signal, and the timing signal generator generates the timing signals at the interval as set by the interval setter.

The sound source controller reads out the sound source control information conforming to the interval as set by the interval setter from the sound source information holder based upon the timing signals from the timing signal generator and controls the sound source based upon the read-out control information.

If the interval setter sets one of the intervals of generating the plural timing signals intervals held by the interval holder as a timing signal generating interval, with the interval thus set being other than the currently set interval, the interval of the timing signals generated by the timing signal generator is changed.

Specifically, the controller controls the setting of the interval setter based upon the load of the information processing other than the sound source control as detected by the load sensor.

At this time, the load required for controlling the sound source based upon the sound source control information is changed. However, the sound source controller reads out from the sound source control information holder the sound source control information corresponding to a newly set interval of generation of the timing signal and controls the sound source based upon the thus read-out control information.

Thus, if the interval of generation of timing signals as the reference of the operation of the sound source controller is changed, the sound source control information is read out in accordance with the interval of generation of the changed timing signal, and the sound source is controlled by the thus read-out sound source information.

DETAILED DESCRIPTION OF THE PRESENTLY PREFERRED EMBODIMENTS

An embodiment of the present invention, in which a sound source control device according to the present invention is constituted as a sound source controller foe generating the music sound or the effect sound for e.g. a video game device, is hereinafter explained.

Figure 1:
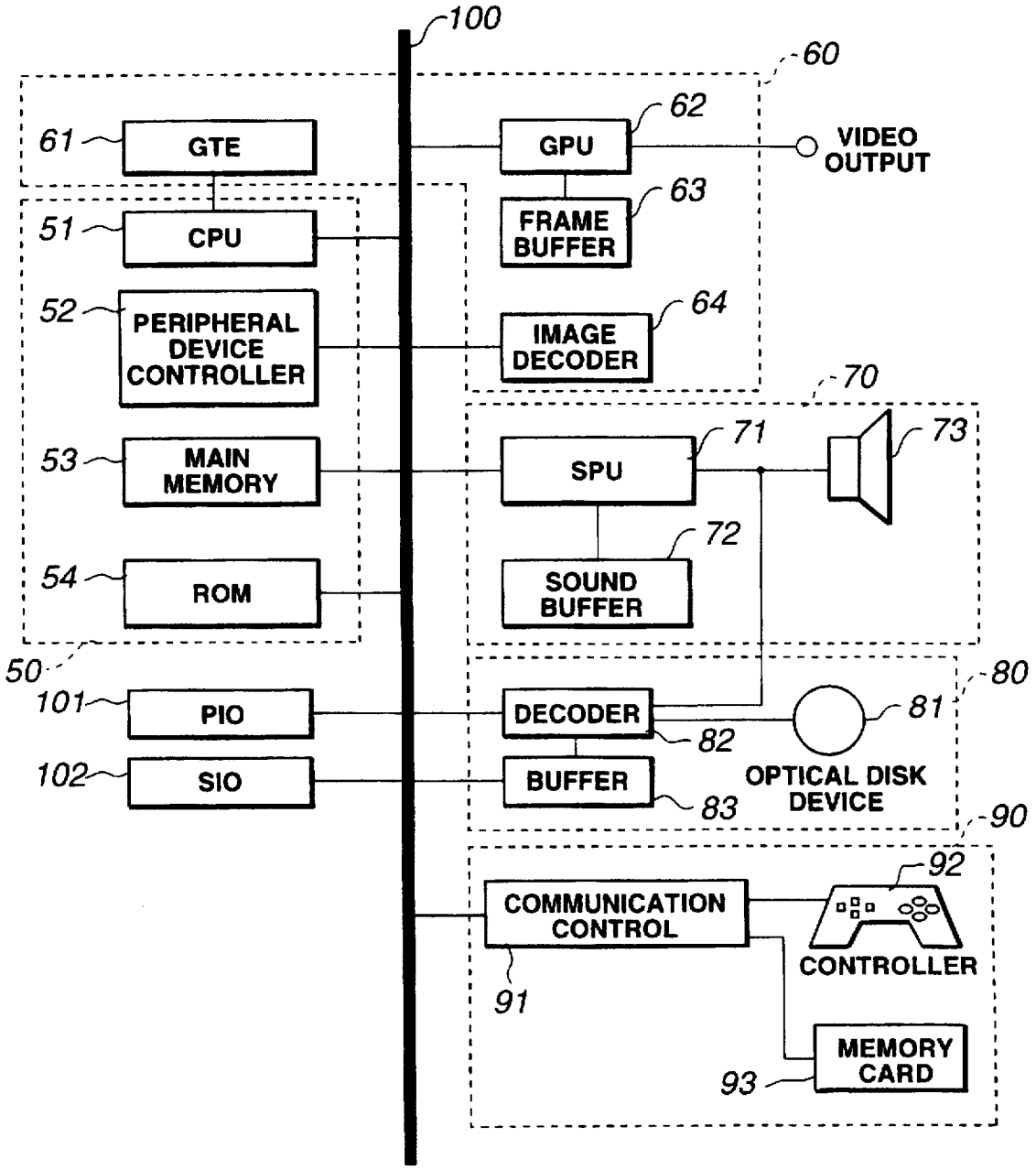
FIG. 1 is a block diagram showing the construction of a video game device to which is applied the sound source control device of the present invention is applied.

The video game device, configured for reading out and executing a game program stored in e.g., an auxiliary memory device, such as an optical disc for carrying out the game responsive to instructions from the user, is constructed as shown in FIG. 1.

That is, the present video game device has a control system 50, composed e.g., of a central processing unit (CPU) and its peripheral devices, a graphic system 60 including a graphic processing unit (GPU) for drawing a picture in a frame buffer, a sound system 70 composed e.g., of a sound processing unit (SPU) for producing e.g., the music sound or the effect sound, an optical disc controller 80 for controlling an optical disc as an auxiliary storage device, a communication controller 90 for controlling a command input from a controller entering a command from the user and input/output to or from an auxiliary storage adapted for storing e.g., game setting, and a bus 100 to which the systems 50 to 90 are connected.

The control system 50 has a CPU 51, a peripheral device controller 52 for controlling an interrupt or a transfer of a direct memory access (DMA), a main memory 53 composed of a RAM, and a ROM 54 for storage of a program, such as a so-called operating system for supervising the main memory 53, graphic system 60 and the sound system 70.

The CPU 51 executes the operating system stored in the ROM 54 for controlling the entire device.

The graphic system 60 has a geometry transfer engine (GTE) 61 for effecting processing such as coordinate transformation, a picture processing device (GPU) 62 for drawing a picture in accordance with picture drawing instructions from the CPU 51, a frame buffer 63 for storing a picture drawn by the GPU 62, and an image decoder 64 for decoding picture data encoded by orthogonal transform such as discrete cosine transform.

The GPU 62 has a parallel calculation function of executing plural calculations in parallel and is configured for executing coordinate transformation, light source calculations, or matrix or vector calculations at a high speed responsive to demand for calculations from the CPU 51.

Specifically, for calculations of flat shading of drawing a picture of a triangular polygon to the same color, it is possible for the GTE 61 to effect up to 1,500,000 polygon coordinate calculations a second. Thus it becomes possible with the present video game device to relieve the load imposed on the CPU 51 and to perform high-speed coordinate calculations.

The GPU 62 carries out drawing of a polygon for the frame memory 62 responsive to a drawing command from the CPU 51. It is possible for the GPU 62 to draw up to a maximum of 360,000 polygons a second.

This frame buffer 63 is comprised of a so-called dual port RAM and is capable of simultaneously effecting picture drawing from the GPU 62 or transfer from the main memory and readout for display simultaneously.

This frame buffer 63 has a capacity of 1 M bytes and is handled as a matrix of 1024 horizontal pixels by 512 vertical pixels, each pixel being made up of 16 bits.

An optional area of the frame buffer 63 may be outputted as a video output.

The frame buffer 63 has, in addition to the display area outputted as a video output, a color look-up table (CLUT) area for storage of the color look-up table to which the GPU 62 refers when drawing e.g., a polygon, and a texture area in which is stored a texture mapped into a polygon drawn by the GPU 62 with coordinate transformation during picture drawing. The CLUT and texture areas are configured for being dynamically changed with changes in the display areas.

The GPU 62 is able to perform, in addition to the flat shading, the Gouraud shading of deciding the color within the polygon by completing from the color of the apex of the polygon and a texture mapping of affixing the texture stored in the texture area in the polygon.

When effecting these Gouraud shading or texture mapping, the GTE 61 is able to perform up to 500,000 polygon coordinate calculations a second.

Under control by the CPU 51, the picture decoder 64 decodes picture data, such as those of a still picture or a moving picture, stored in the main memory 53.

In addition, the reproduced picture data are stored via the GPU 62 in the frame buffer 63, via the GPU 62, so as to be used as the background for the picture drawn by the GPU 62.

The sound system 70 has a sound processing unit (SPU) 71 for producing the music sound, effect sound etc. under instructions from the CPU 51, a sound buffer 72 for storing waveform data etc. by the SPU 71 and a speaker 73 for outputting the music sound or the effect sound generated by the SPU 71.

The SPU 71 has the ADPCM decoding function of reproducing the sound data produced by adaptive differential pulse code modulation (ADPCM) of 16-bit sound data by 4-bit difference signals, a reproducing function of reproducing the waveform data stored in the sound buffer 72 for generating e.g., sound effects, and a modulating function of modulating the waveform data stored in the sound buffer 72 and reproducing the modulated waveform data.

By having the above functions, the present sound system 70 can be employed as a so-called PCM sound source for generating the music sound and the sound effects based upon waveform data recorded in the sound buffer 72 under instructions from the CPU 51.

The optical disc controller 80 has an optical disc device 81 for reproducing the program or data recorded on the optical disc, a decoder 82 for decoding the program or data recorded with e.g., error correction codes, and a buffer 83 for transiently storing playback data from the optical disc device 81 for expediting readout from the optical disc.

Among the sound data recorded on the optical disc and reproduced by the optical disc device 81, there is the so-called PCM data obtained on analog/digital conversion of sound signals in addition to the above-mentioned ADPCM data.

The recorded sound data, recorded as ADPCM data by representing the difference of e.g., 16-bit digital data (PCM data) by 4 bits, is decoded by the decoder 82 and subsequently expanded to 16-bit digital data which is then supplied to the above-mentioned SPU 721.

On the other hand, the sound data, as the PCM data, recorded e.g., as 16-bit digital data, are decoded by the decoder 82 and thence supplied to the SPU 71 or are used for directly driving the speaker 73.

The controller 90 has a communication control unit 91 for controlling communication with the CPU 51 over bus 100, a controller 92 for entering instructions from the user and a memory card 93 for storing e.g., game setting.

For inputting the instructions from the user, the controller 92 has e.g., 16 instruction keys and, in accordance with instructions from the communication controller 91, transmits the state of the instruction keys to the communication controller 91 by synchronous communication about sixty times a second. The communication controller 91 transmits the state of the instruction keys of the controller 92 to the CPU 51.

This enters the instruction from the user to the CPU 51 which then executes processing according to the instructions from the user based upon e.g., the game program which is currently going on.

If it is necessary to store e.g., the game setting which is currently going on, the CPU 51 transmits data to be stored to the communication controller 91, which then stores data from the CPU 51 in the memory card 93.

This memory card 93 is connected via communication control unit 91 to the bus 100 and isolated from the bus 100, so that the memory card can be inserted and taken out with the power source turned on. This enables e.g., game setting in plural memory cards 93.

The present video game device has a parallel input/output (I/O) 101 and a serial input/output (I/O) 102, both of which are connected to the bus 100.

The video game device may be connected to peripheral equipment via the parallel I/O 101, while it is capable of communicating with other video game devices via serial I/O 102.

Meanwhile, a large quantity of picture data needs to be transferred among the main memory 53, GPU 62, image decoder 64 and the decoder 82 at the time of reading out the program, displaying or drawing pictures.

Thus it is possible with the present video game device to effect so-called DMA transfer of directly transferring data among the main memory 53, GPU 62, picture decoder 64 and the decoder 82 under control from the peripheral device controller 52 without interposition of the CPU 51, as explained previously.

This enables the load on the CPU 51 due to data transfer to be relieved to effect high-speed data transfer.

With the present video game device, the CPU 51 executes an operating system stored in the ROM 54 when the power is turned on.

By execution of the operating system, the CPU 51 controls e.g., the graphic system 60 and the sound system 70.

When the operating system is executed, the CPU 51 initializes the entire device, such as for operation confirmation and then controls the optical disc controller 80 for executing the program of a game etc. recorded on the optical disc.

By execution of the game program, the CPU 51 controls the graphic system 60 and the sound system 70 responsive to the input from the user for controlling picture display or generation of the effect sound and the music sound.

Meanwhile, the present video game device has a sound source for generating the sound such as sound effects and a sound source controller for controlling the sound source for generating the music sound or the sound effects with progress of the game, or responsive to the user actuation.

This sound source is realized by the CPU 51 and the SPU 71, while the sound source controller is realized by the CPU 51.

Figure 2:
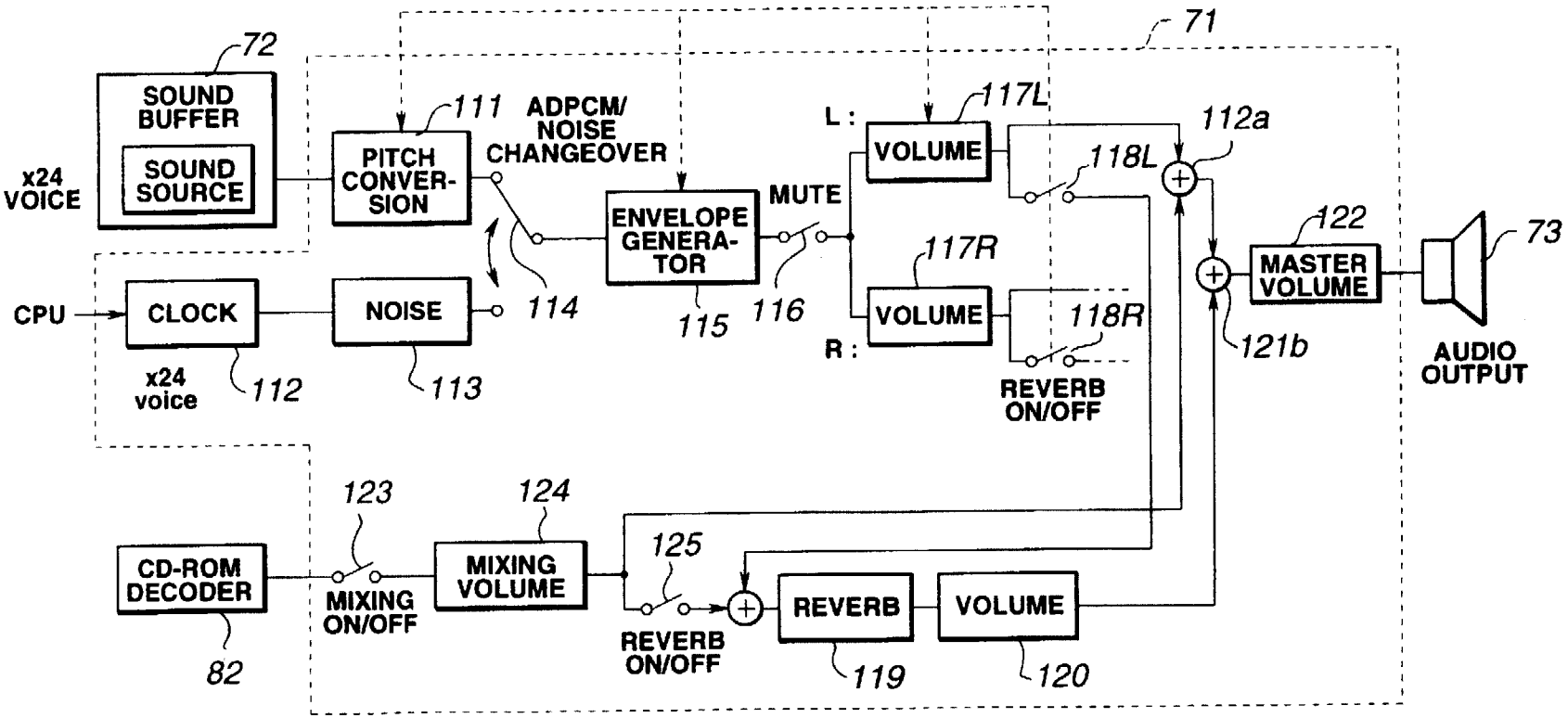
FIG. 2 is a block diagram showing an illustrative construction of a SPU constituting the video game device of FIG. 1.

Specifically, the SPU 71 has a pitch converter 111 for reading out waveform data recorded in the sound buffer 72 responsive to instructions from the CPU 51 and for converting the pitch of the read-out waveform data, a clock generator 112 for generating clock pulse, a noise generator 113 for generating noise based upon an output of the clock generator 112, a switch 114 for switching between outputs of the pitch converter 111 and the noise generator 113, an envelope generator 115 for adjusting an output of the switch 114 for varying the amplitude of the output waveform for converting the envelope of the produced sound, a muting processor 116 for switching between sound emission or non-emission, and left and right volume control units 117L, 117R for adjusting the sound volume and left and right channel balance, as shown in FIG. 2.

The sound buffer 72 has pre-stored therein a plurality of one-period waveform data constituting the sound to be enunciated. These waveform data are stored as the above-mentioned 4-bit ADPCM data and are converted during readout into 16-bit PCM data during readout by the SPU 71 so as to be then supplied to the pitch converter 111.

Consequently, as compared to the case of directly storing the PCM data, the area within the sound buffer 72 required for storing the waveform data may be diminished for enabling storage of a larger quantity of the waveform data.

The main memory 53 also has stored therein the envelope of the sound for the one-period waveform data pre-stored in the sound buffer 72, that is the information concerning the sound rise and decay.

Although a circuit construction for one sound (voice) is shown in FIG. 2, the sound source includes duplicated components from the pitch converters 111 to the volume control units 117L, 117R for a total of 24 sounds (voices). Outputs of the volumes 17L, 17R for the respective vices are synthesized and outputted as the sound output for the left and right channels.

That is, the sound source is capable of simultaneously enunciating 24 voices.

The waveform data stored in the sound buffer 72, envelope, sound volume or the balance of the left and right channels may be independently set for the respective voices.

Thus the sound source is capable of generating chords or performance by plural musical instruments with the use of these voices.

The sound source is also capable of synthesizing sound outputs with temporal offset by way of effecting a so-called reverberation processing.

That is, the SPU 71 has switches 118L, 118R for selecting whether or not the sound output synthesized from 24 voices should be reverberated (reverberation processed), a reverberating (reverberation processing) unit 119 of temporally offsetting the sound output supplied from the switch 118L, a volume control unit 120 for adjusting the temporally offset sound volume, an adder **121*b* for synthesizing an output of the volume control unit 120 to a sound output prior to temporal offsetting, and a master volume unit 122 for adjusting the sound volume of the output of the addition unit 121*b***.

The sound source is capable of synthesizing the sound signals read out from the optical disc and supplied from the decoder to the above-described generated sound output.

Specifically, the SPU 71 has a switch 123 for selecting whether or not the sound signal from the optical disc is to be synthesized to the sound output, a mixing volume control unit 124 for adjusting the sound volume of the synthesized sound signal and supplying the resulting signal to an adder **121*a* and a switch 125** for selecting whether or not the synthesized sound signal is to be reverberated.

Although the construction of the reverberating unit 119, volume 120 and the mixing volume 124 is shown in FIG. 2 only with reference to the left channel, the same construction is used for the right channel.

The operation of the sound source is as follows:

Whenever the necessity arises for sound enunciation, the CPU 51 supplies a selection signal of selecting the waveform data to be enunciated from among plural waveform data stored in the sound buffer 72, and the sound interval of the sound to be enunciated, to the pitch converter 111, while reading out a envelope corresponding to the waveform data to be enunciated from among the envelopes stored in the main memory 53 and furnishing the read-out envelope to the envelope generator 115.

The pitch converter 111 varies the waveform data read-out step in accordance with the instructed sound interval in order to read out the waveform data. When the readout of the waveform data for one period comes to a close, the pitch converter 111 iteratively reads out the same waveform data from the outset during the time period the instructions for sound enunciation are issued.

During the time the instructions for sound enunciation are issued, the waveform data associated with the instructed sound interval is reproduced. These waveform data are supplied via the switch 114 to the envelope generator 115.

The envelope generator 115 converts the amplitude data of the waveform data from the pitch converter 111 based upon the envelope supplied from the CPU 51.

This enunciates one-voice sound. The remaining 23 voices of sound are similarly generated and adjusted for sound volume and balance between the left and right channels before being reverberation-processed as described above and synthesized.

This generates the sound as instructed by the CPU 51.

Controlling the sound source as described above, is realized by the CPU 51 executing the sound control program.

The present video game device is so constructed that music paper data having arrayed time-sequentially thereon the music information such as the sound effects to be produced, waveform data used for the background music (BGM), the sound interval of the generated sound, sound enunciation, sound erasure or the tone color is pre-stored along with the time information in the main memory 53 and the sound source controller sequentially reads out the music paper data at a pre-set time interval for sequentially setting the sound interval of the sound source, and the sound enunciation and sound erasure registers for reproducing the effect sound, BGM or the like.

Figure 3:
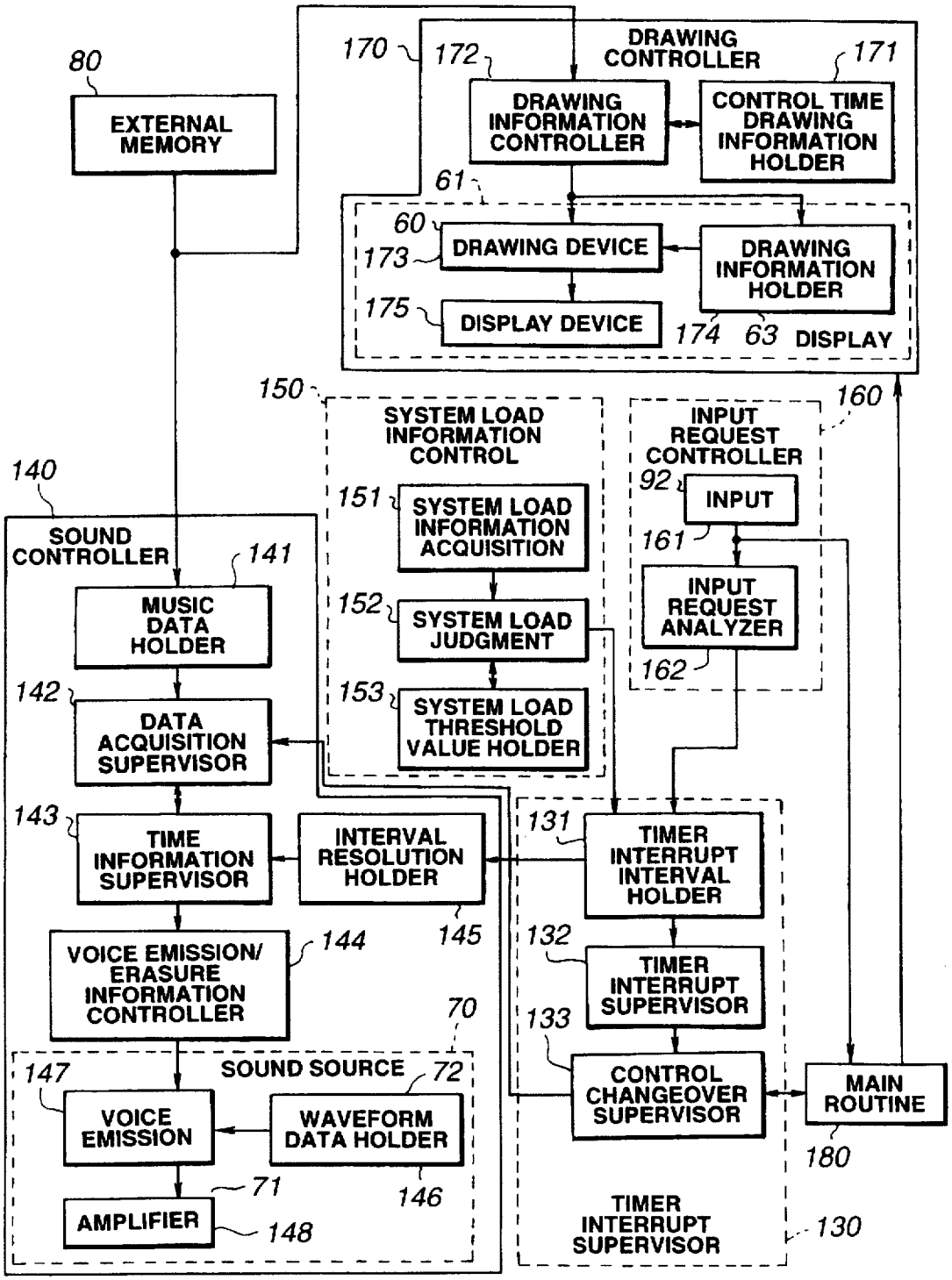
FIG. 3 is a block diagram showing the construction of a sound source control device constituting the video game device.

For controlling the sound source based upon these music paper data, the sound source controller is constructed as shown for example in FIG. 3 illustrating, in an equivalent block diagram, the processing performed by the CPU 51 as a result of execution of the operating system, sound source control program or the game program.

The sound source controller has a timer interrupt controller 130 for controlling the peripheral device controller 52 for generating timer interrupts to the CPU 51 at a pre-set time interval, a sound controller 140 started at a pre-set time interval by the timer interrupts from the peripheral device controller 52 for controlling the sound source based upon the music paper data, a system load information controller 150 for checking the load state of the video game device in its entirety for supplying the result to the timer interrupt controller 130 and an input demand controller 160 for checking the state of the controller 92.

As the processing operations simultaneously executed by the CPU 51 with the processing by the sound controller 140 by the execution of the operating system and the game program, there are those executed by a drawing controller 170 for controlling the picture drawing by the graphic system 60 and by a main routine section 180 for selecting the effect sound to be produced, selection of the music sound, selection of the displayed picture and controlling the game process.

The timer interrupt controller 130 has a timer interrupt interval holder 131 for generating timer interrupts, a timer interrupt supervisor 132 and a control switching supervisor 133 for controlling the switching between the sound controller 140 and the main routine section 180.

The sound controller 140 has a music paper data holder 141, a data acquisition supervisor 142 for supervising the readout of the music paper data, a time information supervisor 143 for controlling the operation of the data acquisition supervisor 142, a sound enunciation/sound erasure information controller 144 for controlling the sound enunciation/sound erasure based upon the read-out music paper data, an internal resolution holder 145 for holding the internal resolution conforming to the timer interrupt interval from the timer interrupt interval holder 131, and the above sound source.

The sound source has a sound enunciation section 147 made up of the SPU 71 and the sound buffer 72 and adapted for reading out waveform data stored in a waveform data holder 146 composed of the sound buffer 72 under control by the sound enunciation/sound erasure information controller 144 for generating the sound, and an amplifier 148 for amplifying the produced sound for adjusting the sound volume. The sound enunciation section 147 and the amplifier 148 are realized as performing one of the functions of the SPU 171, as described previously.

The system load information controller 150 has a system load information acquisition unit 151 for acquiring the system load information, a system load judgment section 152 for judging the system load and a system load threshold value holder 153 for holding the system load threshold value.

The input request controller 160 has an input 161 made up e.g., of the controller 92, and an input request analysis unit 162 for analyzing the input request from the input device 161.

The picture-drawing controller 170 has a control time picture drawing information holder 171, made up of the CPU 151, GTE 61, GPU 62 and the frame buffer 63 as well as the GTE 61, a picture-drawing information controller 172, made up e.g., of the CPU 51, a picture-drawing device 173, made up of the GPU 62, a picture-drawing information holder 174, made up of the frame buffer 63, and a display 175 for displaying a picture based upon a video output from the picture-drawing device 173.

The operation of the sound source controller is as follows:

With the present sound source controller, the system load or the timer interrupt interval conforming to the input demand is previously held in the timer interrupt interval holder 131. Specifically, the timer interrupt interval for a light system load of 1/240 second, and the timer interrupt interval for a heavy system load of 1/60 second, longer than the value for the light system load, are held in the holder.

On starting the processing, the sound source controller executes, by the main routine section 180 executed by the CPU 51, the control of the picture-drawing unit 170 responsive to the input from the input device 161, the selection of the music sound generated by the sound controller 140 and processing of the system load information controller 150, as a parallel operation.

The system load information acquisition unit 151 acquires the load information of the CPU 51 to supply the acquired information to the system load judgment unit 152, which then compares the supplied information to the threshold value held by the system load threshold value holder 153 to judge the system load and transmits the result of judgment to the timer interrupt interval holder 131.

The timer interrupt internal holder 131 selects the timer interrupt interval, based upon system load judgment from the system load judgment unit 152 or an output of the input request analysis unit 162 and routes the selected interrupt interval to the timer interrupt supervisor 132 and to the internal resolution holder 145.

Specifically, the timer interrupt interval holder 131 sets the interrupt interval to 1/240 second and to 1/60 second, for the light system load and for the heavy system load, respectively, based upon the result of judgment from the system load judgment unit 152.

The timer interrupt supervisor 132 controls the peripheral device controller 52, based upon the timer interrupt interval supplied from the timer interrupt interval holder 131, for generating timer interrupt at a pre-set time interval. The control changeover supervisor 133 switches between processing of the main routine section 180 and the processing of the sound controller 140 at a pre-set time interval based upon the timer interrupt for starting the processing of the sound controller 140.

When the processing is started with switching of the control changeover controller 133, the time information supervisor 143 of the sound controller 140 controls the data acquisition supervisor 142 responsive to the internal resolution, that is the timer interrupt interval, held by the internal resolution holder 145, for instructing readout of data corresponding to the timer interrupt interval from the music paper data held on the music paper data holder 141, and routes the read-out music paper data to the sound enunciation/sound erasure information controller 144.

The sound enunciation/sound erasure information controller 144 controls the sound enunciation unit 147 based upon the music paper data supplied from the time information supervisor 143. This causes the sound enunciation unit 147 to generate the sound based upon the waveform data held by the waveform data holder 146.

Specifically, by execution of the sound enunciation/sound erasure controller 144, the CPU 51 controls the pitch converter 111 and the envelope generator 115 etc. in the manner as described above for controlling the sound generation. The sound thus generated is adjusted in level by the amplifier 148 so as to be outputted by the speaker 73.

This outputs sound data corresponding to the music paper data for the timer interrupt interval supplied from the timer interrupt interval holder 131.

The sound controller 140 is started at the timer interrupt interval as set by the timer interrupt interval holder 131 as described above for sequentially generating the sound corresponding to the music paper data for the timer interrupt time interval.

Figure 4A:
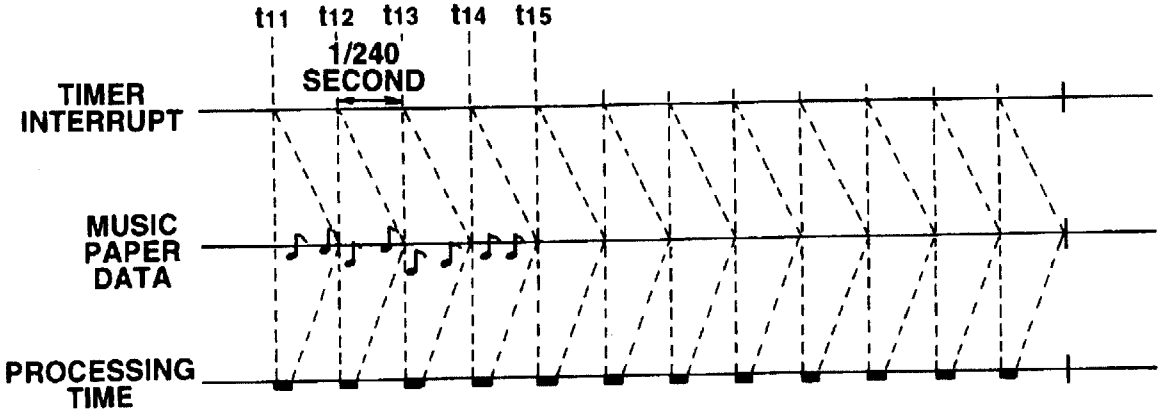
FIG. 4 illustrates the processing by a sound controller constituting the sound source device by timer interrupt.

That is, if the timer interrupt interval is 1/240 second, the music paper data is reproduced at an interval of 1/240 second, as shown in FIG. 4*a*.

At this time, the actual processing time of the sound processor 140 is shorter than 1/240 second.

For example, two music notes are reproduced during time intervals of from time t11 till time t12, from time t12 till time t13, from time t12 till time t14 and from time t14 till time t15. That is, two music notes are reproduced during 1/60 second of from time t11 till time t15.

Figure 4B:
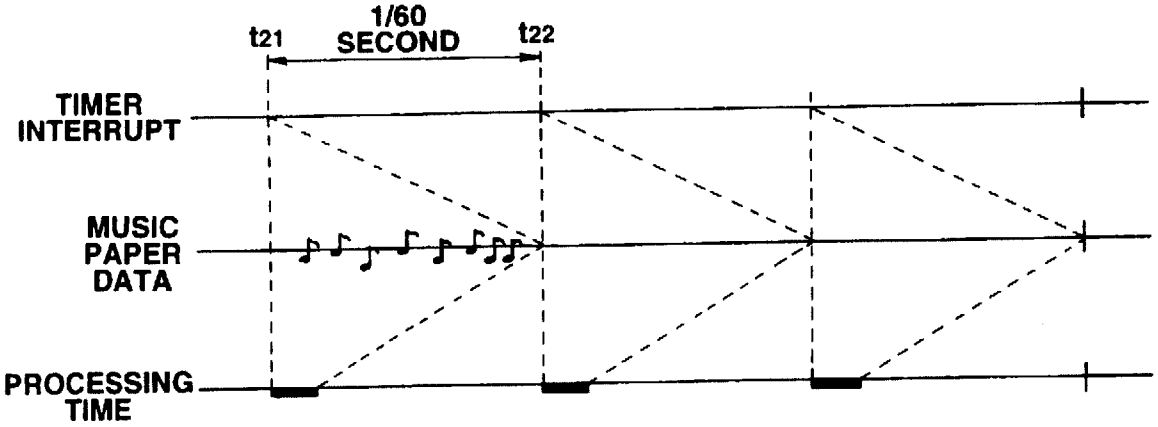

If the timer interrupt interval is 1/60 second, music paper data is reproduced at an interval of 1/60 second, as shown in FIG. 4*b*. For example, eight music notes are reproduced during 1/60 second of from time t21 till time t22.

That is, eight music notes are reproduced during 1/60 second as in the case of setting the timer interrupt interval to 1/240 second.

Thus, with the present sound source processing device, even if the timer interrupt interval is changed with the use of the same music paper data, the music paper data is reproduced at a pre-set tempo by controlling the readout of the music paper data responsive to the changed timer interrupt interval.

Figure 5A:
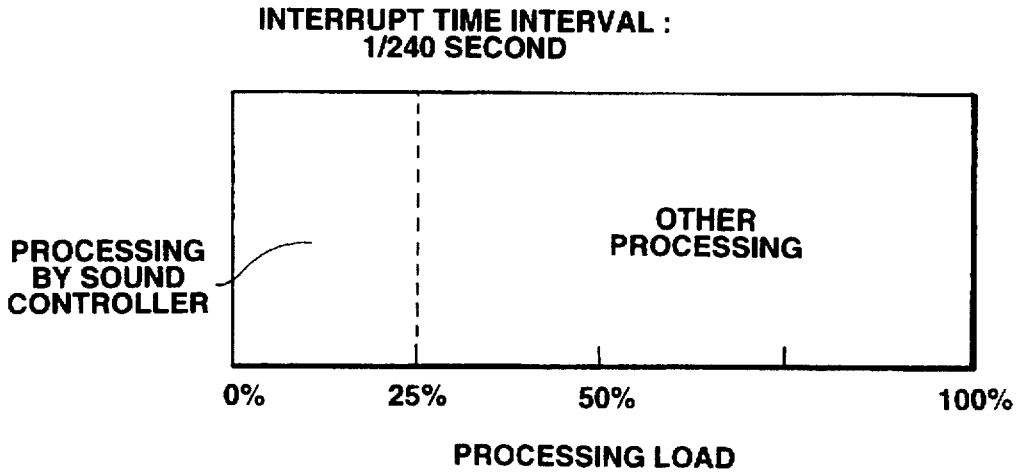
FIG. 5 illustrates the ratio of the load of the processing operation of the sound controller to that of other processing operations.
Figure 5B:
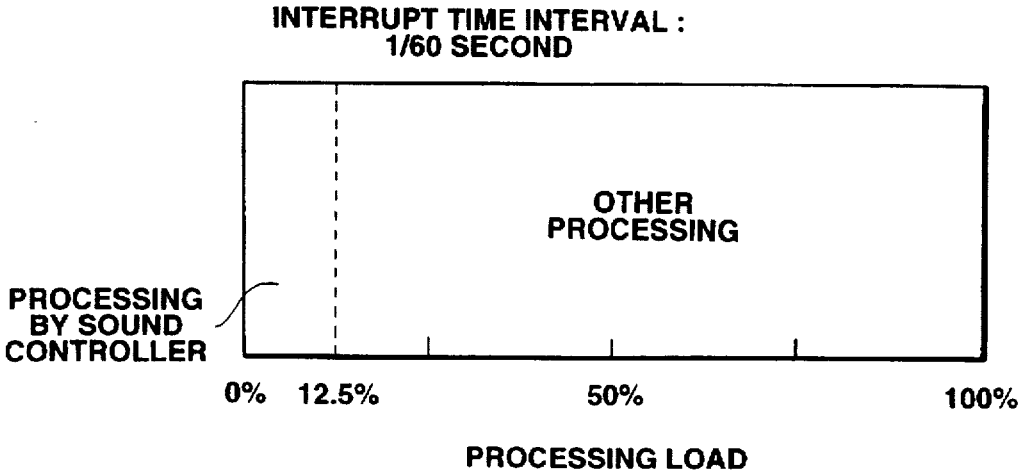
Figure 6:
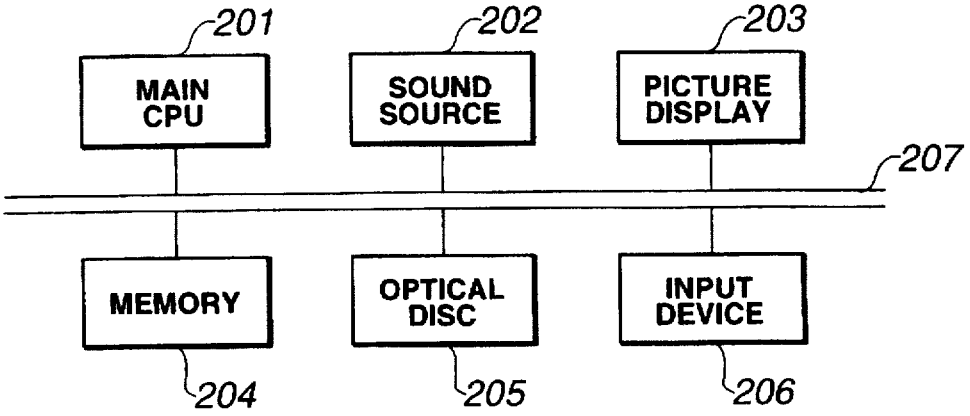
FIG. 6 is a block diagram showing a construction of a conventional sound source control device.
Figure 7:
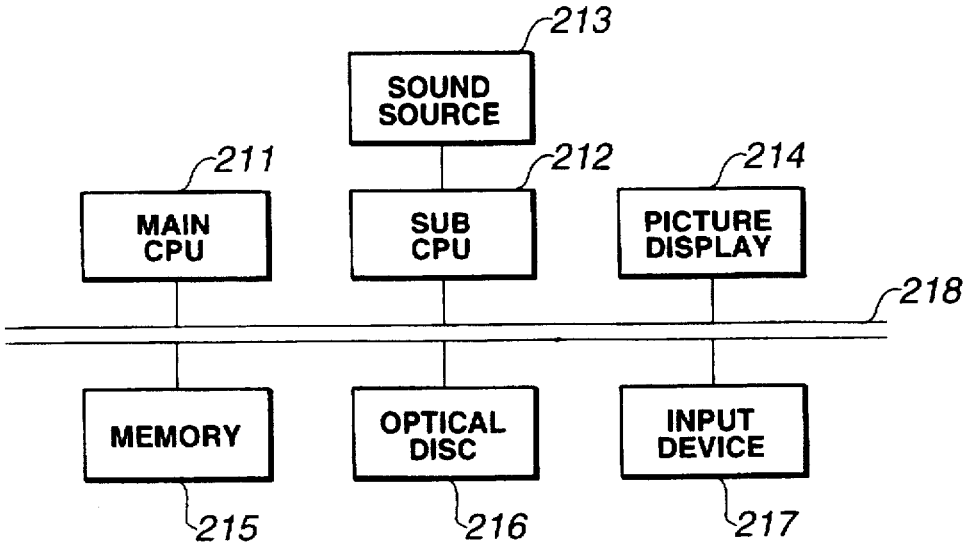
FIG. 7 is a block diagram showing another construction of a conventional sound source control device.

If processing is executed by starting the sound controller 140 by interrupt as described above, and the timer interrupt interval is 1/240 second, the processing of the sound processor 140 accounts for 25% of the processing capability of the CPU 51, as shown for example in FIG. 5*a*. If the timer interrupt interval is 1/60 second, the processing of the sound processor 140 accounts for 12.5% of the processing capability of the CPU 51, as shown for example in FIG. 5*b*.

That is, while the load on the CPU 51 for actually controlling the sound source is not vitally changed even if the timer interrupt interval becomes shorter, the overhead for timer interrupt processing is increased if the timer interrupt interval becomes shorter and timer interrupt occurs frequently, so that the load on the sound controller 140 is increased.

With the above-described sound source controller, the timer interrupt interval selected by the timer interrupt holder 131 is set to 1/240 second and to 1/60 second for the light and heavy system loads, respectively. For the timer interrupt intervals of 1/240 second and 1/60 second, the processing load on the sound controller 140 becomes larger and smaller, respectively.

Thus, with the present sound source controller, the processing load on the sound controller 140 may be changed responsive to the system load without changing music paper data. Thus, with the heavier system load, the processing load on the sound controller 140 becomes smaller, thus allowing smooth processing, such as picture drawing.

With the above-described embodiment, the system load judgment section 152 compares the system load information supplied from the system load information acquisition unit 151 to a threshold value held by the system load threshold value holder 153 and selects the timer interrupt interval held by the timer interrupt interval holder 131 based upon the results of comparison. Alternatively, the timer interrupt interval may be controlled by program control of the main routine section 180. Still alternatively, the timer interrupt interval may be set by an input request from the input device 161. The effects similar to those of the above embodiment may be obtained, since it is possible to vary the timer interrupt interval.

Although the present invention has been explained in the above embodiment as it is applied to a sound source controller for controlling the sound source in a video game device, the sound source controlling device may be applied to e.g., an automatic performance device or a personal computer provided that the sound source controlling device is adapted for executing other processing operations such as the processing of a picture display device in addition to controlling the sound source. Other modifications may be made if within the scope of the present invention.

With the sound source controlling device according to the present invention, if the interval of generation of the timing signal as the reference of the operations of the sound source controller is changed by the interval setting device, the sound source control information can be read out in accordance with the interval of generation of the modified timing signals so that the sound source can be controlled by the thus read-out source control information.

Thus, even if the interval of generation of the timing signals is changed for playback using the same sound source control information without changing the music control information, the music composition can be reproduced at a pre-set tempo so that the tempo of the reproduced music composition is not changed. On the other hand, the load required for controlling the sound source may be changed by changing the interval of generation of the timing signals.

With the sound source control device of the present invention, the controller controls the setting of the load of the interval setting unit based upon the load of information processing other than the control of the sound source detected by the load detecting unit so that the load required for controlling the sound source can be changed responsive to the load of information processing other than the control of the sound source and hence the load required for controlling the sound source may be diminished at such time when the load for information processing other than control of the sound source is increased.

The system load information acquisition unit 151 is implemented by apparatus for determining how busy the main CPU is at any given time. In one arrangement, the system load may be determined by how much time is required for the CPU to service the drawing controller 170. In routines in which the use of the drawing controller is intensive, the main CPU may set a flag before initiating operations having to do with the drawing controller. When these operations are complete, the flag is reset, before other operations are performed in the main routine. This flag may then be examined periodically by an interrupt routine. If the flag is found to be set, it is known that the main routine was interrupted during drawing operations, and if this happens frequently, it is known that there is heavy load on the main CPU because of the drawing operations. In this event, the system load judgment unit recognizes that the system load exceeds the threshold value, and accordingly adjusts the timer interrupt interval held in the timer interrupt interval holder 131. On the other hand, if the drawing flag is found frequently to be reset, it is known that the drawing operations do not represent a heavy load on the main CPU, so that the timer interrupt interval can be adjusted accordingly.

It will be apparent that various other means can be employed for defining the system load, and for judging whether the system load requires a change in the interrupt interval. These and other modifications of the apparatus disclosed herein may be made by those of ordinary skill in the art, without departing from the central features of novelty of the present invention, which are intended to be defined and secured by the appended claims.

What is claimed is:

1. A processor controlled device including an apparatus for generating an audio signal by reading out data from a sound source which is controlled by a processing unit comprising:

generator means for generating a plurality of interrupt signals having different interrupt intervals;

detector means for detecting a load condition of said processing unit based on a processing unit load attributed to elements in addition to the sound source:

selector means for selecting one of said interrupt signals in response to an output of said detector means; and control means for controlling said reading out of data from said sound source in response to said interrupt signal selected by said selector means.

2. A processor controlled device according to claim 1, wherein said processing unit also controls a graphic processing apparatus.

3. A processor controlled device according to claim 2, wherein said data read-out from said sound source is musical note data.

4. A processor controlled device according to claim 3, wherein said reading out of data is controlled so that a tempo of said musical note data read out from said sound source is constant regardless of said interrupt signal.

5. A processor controlled device according to claim 3, wherein said sound source comprises a PCM signal.

6. A processor controlled device according to claim 5, wherein said sound source has a waveform memory.

7. A processor controlled device according to claim 3, wherein said sound source comprises a FM signal.

8. A method of operating a processor controlled device and generating an audio signal from a sound source which is controlled by a processing unit, comprising the steps of:

detecting a load condition of said processing unit based on a processing unit load attributed to elements in addition to the sound source;

selecting an interrupt signal rate in response to the detected load condition of said processing unit; and controlling the read out of data from said sound source in response to said selected interrupt signal.

* * * * *